US009162508B2

(12) United States Patent
Sahara

(10) Patent No.: US 9,162,508 B2
(45) Date of Patent: Oct. 20, 2015

(54) INKJET RECORDING APPARATUS

(71) Applicant: CANON KABUSHIKI KAISHA, Tokyo (JP)

(72) Inventor: Akiyoshi Sahara, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/024,463

(22) Filed: Sep. 11, 2013

(65) Prior Publication Data

US 2014/0078203 A1 Mar. 20, 2014

(30) Foreign Application Priority Data

Sep. 14, 2012 (JP) ..... 2012-203090

(51) Int. Cl.

| | |
|---|---|
| ***B41J 29/393*** | (2006.01) |
| ***B41J 29/02*** | (2006.01) |
| ***B41J 29/38*** | (2006.01) |
| *B41J 11/00* | (2006.01) |

(52) U.S. Cl.

CPC ..... *B41J 29/393* (2013.01); *B41J 29/02* (2013.01); *B41J 29/38* (2013.01); *B41J 11/008* (2013.01); *B41J 11/0095* (2013.01)

(58) Field of Classification Search

CPC ..... B41J 29/38; B41J 11/008; B41J 2/0458; B41J 2/04598; B41J 11/0095

USPC ..... 347/14–16, 19, 20, 54, 57, 60

See application file for complete search history.

(56) References Cited

U.S. PATENT DOCUMENTS

| | | | | |
|---|---|---|---|---|
| 6,761,430 | B2 | 7/2004 | Kinoshita | |
| 7,578,574 | B2 * | 8/2009 | Suzuki | 347/35 |
| 8,342,628 | B2 * | 1/2013 | Ito et al. | 347/14 |
| 2012/0162302 | A1 * | 6/2012 | Oguchi et al. | 347/16 |

FOREIGN PATENT DOCUMENTS

| | | |
|---|---|---|
| JP | 2008-37006 A | 2/2008 |

* cited by examiner

*Primary Examiner* — Thinh Nguyen

(74) *Attorney, Agent, or Firm* — Canon U.S.A., Inc., IP Division

(57) ABSTRACT

An inkjet recording apparatus that performs preliminary discharge operation without a carriage and a recording medium interfering with each other is provided. The inkjet recording apparatus performs, at a center region in a conveyance direction of a recording medium, the preliminary operation at a position according to an edge portion of the recording medium obtained by an optical sensor. Further, the inkjet recording apparatus performs, at a leading edge region and a trailing edge region of a recording medium, the preliminary operation at a position based on input data.

10 Claims, 11 Drawing Sheets

FIG.4

| RECORDING MEDIUM WIDTH INFORMATION | PRELIMINARY DISCHARGE POSITION |
|---|---|
| LESS THAN A | 21c/21d |
| GREATER THAN OR EQUAL TO A AND LESS THAN B | 21b/21e |
| GREATER THAN OR EQUAL TO B | 21a/21f |

INKJET RECORDING APPARATUS

BACKGROUND

1. Field

Aspects of the present invention generally relate to an inkjet recording apparatus.

2. Description of the Related Art

When an inkjet recording apparatus has not discharged ink for a predetermined period, thickening of the ink in a nozzle of a recording head occurs, so that there is fear that the inkjet recording apparatus becomes unable to normally discharge the ink. To prevent such a problem, the inkjet recording apparatus performs a preliminary discharge operation, i.e., regularly discharges the ink in the nozzle during printing operation. The nozzle is thus maintained in a satisfactory condition.

However, if the inkjet recording apparatus performs the preliminary discharge operation at a position too close to an edge of a recording medium, there is fear that the preliminary-discharged ink adheres to and stains the recording medium. On the other hand, if the inkjet recording apparatus performs the preliminary discharge operation at a position far away from the recording medium, a moving distance of the recording head becomes long, so that throughput is lowered. As a result, it is necessary for the inkjet recording apparatus to perform the preliminary discharge operation at an appropriate position corresponding to a width of the recording medium.

U.S. Pat. No. 6,761,430 discusses a technique in which a carriage is provided with an optical sensor including a light emitting unit and a light receiving unit. The optical sensor then detects the recording medium based on an amount of light reflected from the recording medium, and identifies an edge position of the recording medium. The preliminary discharge operation is thus performed at the position based on the identified edge position.

The ink which is preliminary-discharged from the inkjet recording apparatus discussed in U.S. Pat. No. 6,761,430 is receptive to an absorbing member on a platen. However, if a large amount of ink is preliminary-discharged, the ink may not sufficiently dry on the absorbing member, and thus remain as a residual substance thereon. If the optical sensor then performs detection of the recording medium on the absorbing member in such a state, the following may occur. The light reflected from a surface of the ink residual substance may cause the optical sensor to falsely detect the recording medium even when there is no recording medium. The width of the recording medium may thus be misrecognized to be greater than the actual width. Further, if the carriage performs scanning while misrecognition has occurred, the carriage moves to an outer side of the recording medium when the preliminary discharge operation is to be performed.

Furthermore, the above-described inkjet recording apparatus conveys the recording medium using a conveyance roller pair and a discharge roller pair. When the inkjet recording apparatus conveys a center region of the recording medium, the recording medium is pinched by both the conveyance roller pair and the discharge roller pair. However, when the inkjet recording apparatus conveys a leading edge region or a trailing edge region of the recording medium, the recording medium is pinched by only one of the conveyance roller pair and the discharge roller pair. As a result, there is fear that the inkjet recording apparatus may convey the leading edge region or the trailing edge region of the recording medium while the recording medium is floating above the platen.

If the carriage moves to the outer side of the recording medium while the recording medium is floating, the carriage and the recording medium may interfere when the carriage performs scanning after reversing. In such a case, the recording medium may become rolled in, or a discharge port surface of the recording head may become damaged. As a result, if there is a possibility that the recording medium may float when the inkjet recording apparatus is to perform the printing operation and the preliminary discharge operation, the inkjet recording apparatus is required to scan the carriage without moving the carriage to the outer side of the recording medium.

SUMMARY

Aspects of the present invention are generally directed to providing an inkjet recording apparatus that performs a preliminary discharge operation without the carriage interfering with the edge of the recording medium, even when the edge position of the recording medium is falsely detected that it is at the outer side of the actual edge position.

According to an aspect of the present invention, an inkjet recording apparatus includes a carriage on which a recording head configured to discharge ink and perform recording on a recording medium is mounted and configured to move in a first direction, a conveyance unit configured to convey a recording medium in a conveyance direction that intersects the first direction, and a preliminary discharge unit configured to cause the recording head to perform a preliminary discharge operation, wherein the preliminary discharge unit determines, based on a position in the conveyance direction of a recording medium, a preliminary discharge position at which the recording head is caused to perform the preliminary discharge operation.

Further features and aspects of the present disclosure will become apparent from the following description of exemplary embodiments with reference to the attached drawings.

BRIEF DESCRIPTION OF THE DRAWINGS

FIG. 4 illustrates a relation between the width of the recording medium and the preliminary discharge position.

DESCRIPTION OF THE EMBODIMENTS

According to the following embodiment(s), the term "recording" is applicable to forming both meaningful information such as text and drawings meaningless information. Further, "recording" broadly indicates forming an image, a design, or a pattern on a recording medium, or processing a medium, regardless of whether an output is elicited to be visually-perceptible.

Further, the term "recording medium" is not limited to paper used in a general recording apparatus, and widely includes materials which can receive ink. Such materials include, but are not limited to, vinyl, cloth, plastic film, metal plate, glass, ceramics, wood, and leather.

Furthermore, the "ink" (which may also be referred to as "liquid") is to be widely interpreted. In other words, "ink" indicates a liquid applied to a recording medium to form an image, a design, or a pattern, or process the recording medium, or process ink.

The following exemplary embodiment(s) will be described below with reference to the drawings. Configurations having similar functions will be assigned the same reference numbers, and description thereof may be omitted.

Figure 1:
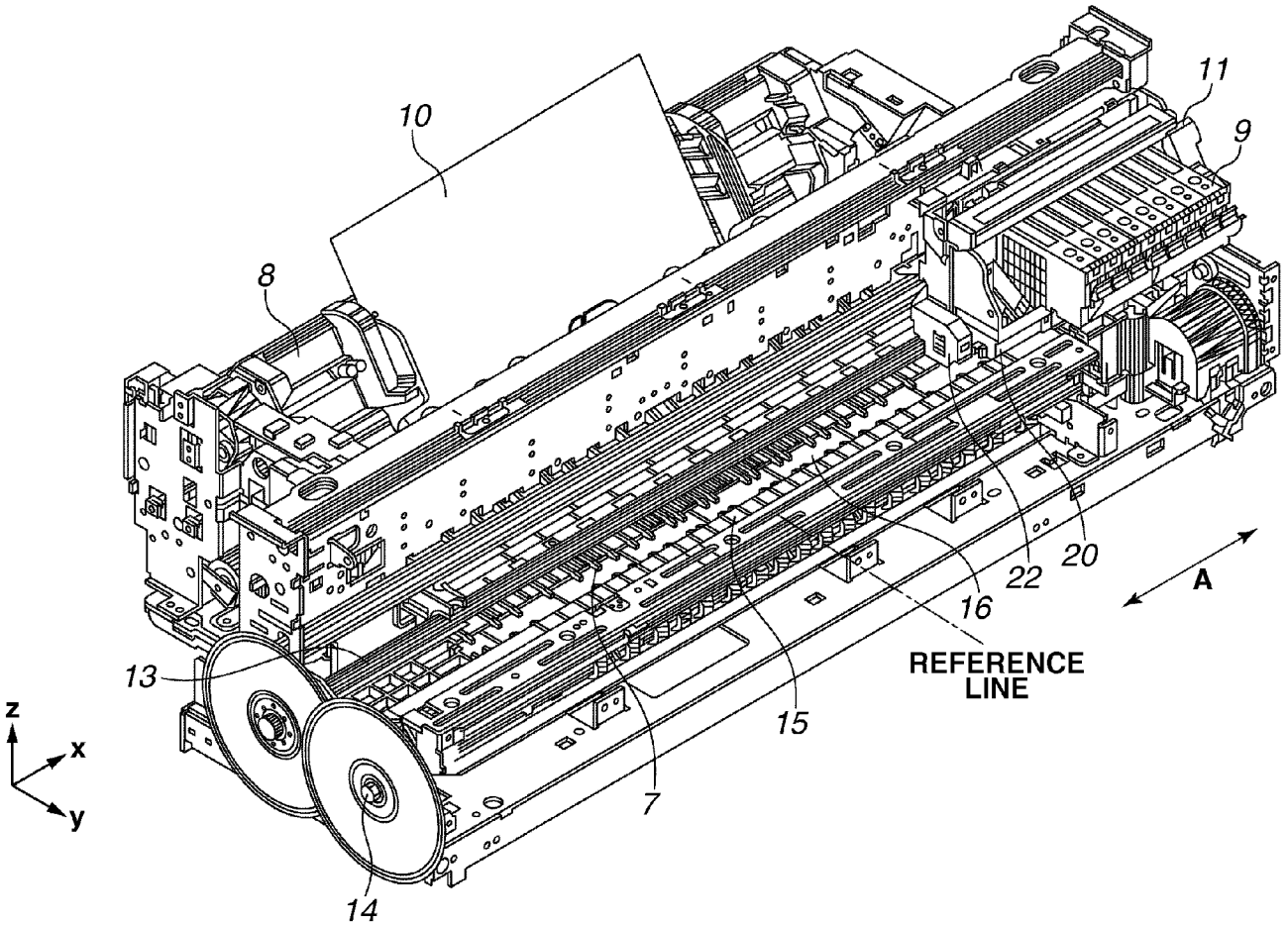
FIG. 1 is a perspective view illustrating a configuration of the inkjet recording apparatus according to an exemplary embodiment.
Figure 2:
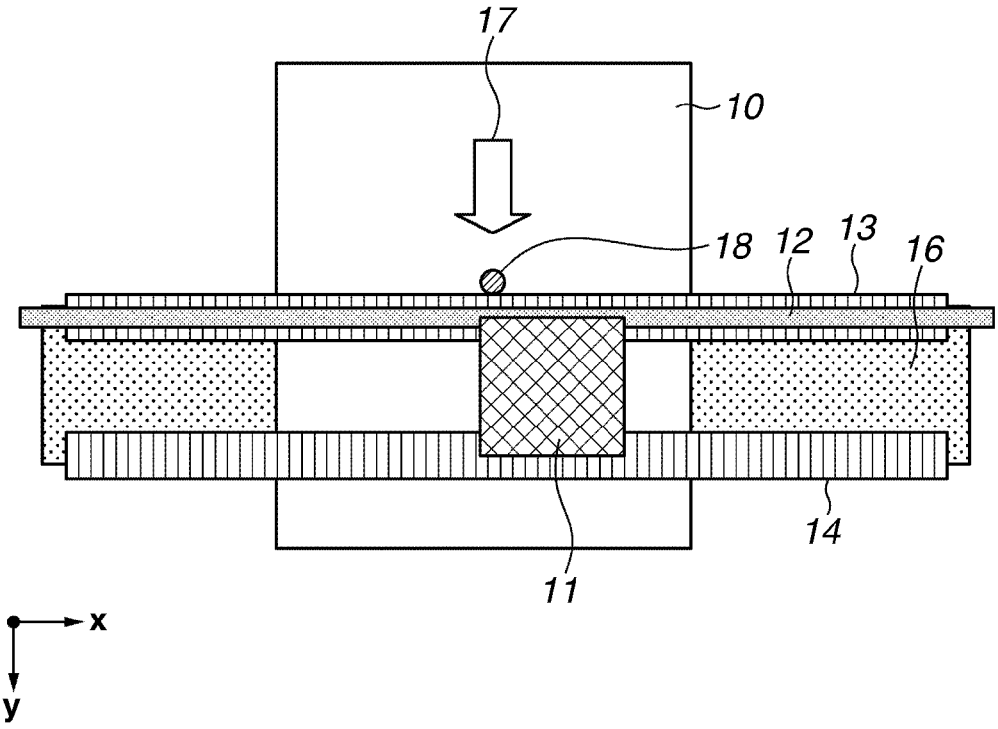
FIG. 2 is a schematic top view illustrating the inkjet recording apparatus.

FIG. 1 is a perspective view illustrating the configuration of the inkjet recording apparatus according to an exemplary embodiment. FIG. 2 is a schematic diagram illustrating the inkjet recording apparatus as viewed from the top.

Referring to FIG. 1, the inkjet recording apparatus (hereinafter also referred to as a recording apparatus) includes an inkjet recording head (hereinafter also referred to as a recording head) 20 which discharges the ink and performs recording. The recording head 20 is mounted on a carriage 11. A conveyance roller 13 and a discharge roller 14 convey a recording medium 10. A recording paper stacked in a paper feed unit 8 is conveyed to a recording position. The carriage 11 then performs reciprocal scanning of the recording head 20 on the recording medium 10 in a direction indicated by an arrow A (i.e., a first direction) illustrated in FIG. 1. The direction indicated by the arrow A intersects the conveyance direction of the recording medium 10 (i.e., a second direction). The recording head 20 thus discharges the ink on the recording medium 10 in such a state, so that the recording apparatus performs recording of 1 band.

As described above, the recording apparatus performs a serial print method, i.e., the conveyance roller 13 and the discharge roller 14 performs intermittent conveyance of the recording medium 10 by one band, and the carriage 11 performs reciprocal scanning. The recording apparatus thus forms an image on the recording medium 10.

According to the present exemplary embodiment, the recording apparatus conveys the recording medium 10 with reference to the center. A center position in a width direction of the recording medium 10 of all sizes is thus conveyed through a reference line (i.e., a reference position) with respect to a scanning direction of the recording apparatus.

Further, referring to FIG. 2, a paper feed sensor 18 (i.e., a detection sensor) capable of detecting that the leading edge position or the trailing edge position of the recording medium 10 has passed through is located on the upstream side of the conveyance roller 13.

A plurality of ink cartridges 9 for storing the ink to be supplied to the recording head 20 is mounted on the carriage 11. The ink cartridges 9 are detachably-attachable to the carriage 11, and respectively store cyan, magenta, yellow, and black inks for performing color printing.

A plurality of discharge port arrays (not illustrated) in which a plurality of discharge ports for discharging the ink is arranged is located on the recording head 20. Further, a recording element which generates energy for discharging the ink is located corresponding to each discharge port. For example, an electrothermal conversion element which uses heat energy generated by energization and discharges ink may be used as the recording element. More specifically, a pulse voltage is applied to the electrothermal conversion element according to a recording signal, so that the ink is discharged from the discharge port.

A platen 15 (i.e., a supporting member) including a plurality of ribs 7 is located at a position facing the discharge port surface of the recording head 20. The plurality of ribs 7 is a conveyance datum surface for managing the distance between the discharge port surface and the recording medium.

The recording apparatus discharges the ink from the recording head 20 to a recording surface of the recording medium 10 supported by the ribs 7 in the platen 15. The desired recording can thus be performed. Further, an absorbing member 16 is located over the entire width of the platen 15. The absorbing member 16 receives the ink that has been preliminary-discharged, or has run off the edge of the recording medium in a case where the recording apparatus performs borderless recording.

Figure 5A:
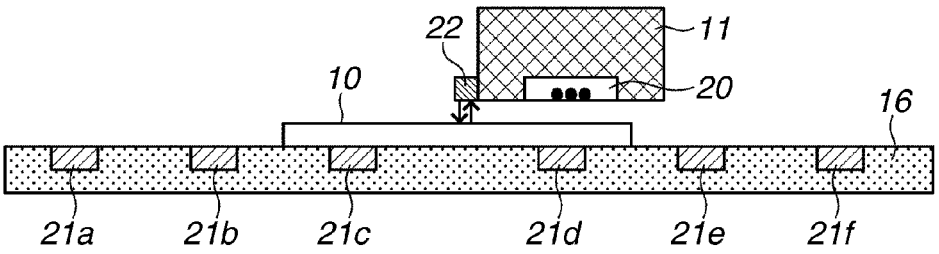
FIGS. 5A and 5B illustrate a detection method using the optical sensor.
Figure 5B:
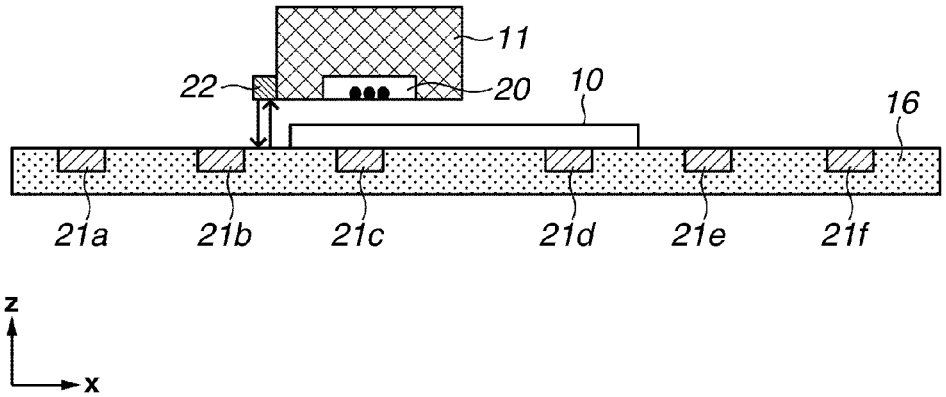

If the above-described inkjet recording apparatus does not discharge the ink for a predetermined period, the thickening of the ink in the nozzle of the recording head occurs, so that the recording apparatus may not be able to normally discharge the ink. To prevent this from occurring, the recording apparatus regularly performs the preliminary discharge operation even while performing printing operation. The recording apparatus thus discharges the ink in the nozzle, and maintains the nozzle in a satisfactory condition. The recording apparatus can perform the preliminary discharge operation at any of a predetermined plurality of preliminary discharge positions 21 in the scanning direction of the carriage 11, as illustrated in FIGS. 5A and 5B. The absorbing member 16 receives the preliminary-discharged ink.

Further, a recovery unit (not illustrated) may be located near an end of a reciprocal scanning path of the recording head 20, for example, at a home position. A capping mechanism that caps a nozzle surface of the recording head and prevents ink evaporation may be disposed as the recovery unit. Further, a suction unit may also be disposed as the recovery unit. The suction unit generates negative pressure while the nozzle surface is capped, and sucks and discharges from the nozzle foreign substances such as the thickening ink and bubbles. The suction unit thus refreshes the ink in the discharge port, and maintains and recovers ink discharge performance. Furthermore, a wiper blade (i.e., a wiping unit) for wiping (wipe-cleaning) the foreign substance such as the ink adhering to the discharge port surface of the recording head may also be disposed as the recovery unit.

An optical detection sensor 22 is arranged on the carriage 11, facing the recording position of the recording medium 10 on the absorbing member 16. The detection sensor 22 moves along with the movement of the carriage 11, and thus detects the recording medium at a desired position. The detection sensor 22 includes a light emitting unit configured to emit light, and a light receiving unit configured to receive reflected light. The absorbing member 16 is a sponge-like member formed of a black resin material, and reflectivity thereof is smaller than that of the recording medium. As a result, the detection sensor 22 can determine whether the absorbing member 16 is being detected or the recording medium 10 is being detected, based on the difference of electric output according to the reflected light received by the light receiving unit. If the reflectivity of the surface of the platen 15 is set smaller than that of the recording medium, the detection sensor 22 can detect whether there is the recording medium on the platen 15.

Figure 3:
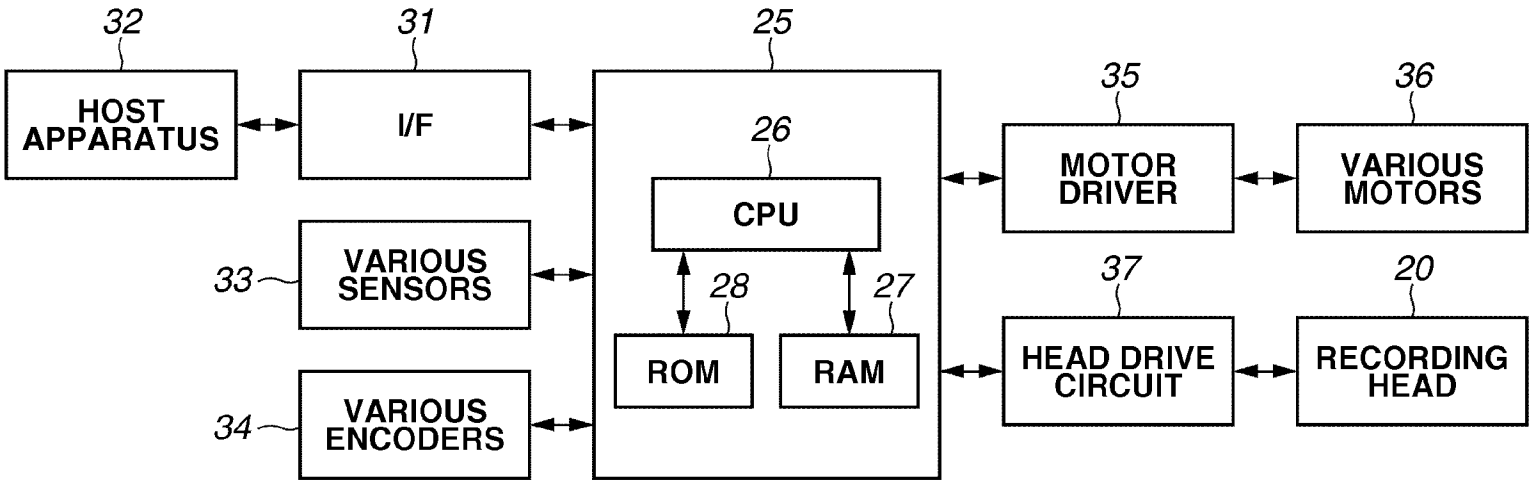
FIG. 3 is a block diagram illustrating a control configuration of the inkjet recording apparatus.

FIG. 3 is a block diagram illustrating the system configuration of the inkjet recording apparatus, centered on a control unit. Referring to FIG. 3, a control unit 25 includes a central processing unit (CPU) 26 configured to perform control, a random access memory (RAM) 27 that temporarily stores data while the control unit 25 performs control, and a read-only memory (ROM) 28 that stores a control program. The control unit 25 is connected to a host apparatus 32 via an interface (I/F) 31. The control unit 25 thus receives from the host apparatus 32, recording data and data on size information of the recording medium, and notifies the host apparatus 32 of an apparatus status.

Further, the control unit 25 is connected to various sensors 33, including the paper feed sensor 18 and the detection sensor 22, and is capable of obtaining sensor signals. Furthermore, the control unit 25 is connected to various encoders 34, and can detect rotation of the conveyance roller 13 and the position of the carriage 11.

Moreover, the control unit 25 is connected to a motor driver 35 and a head drive circuit 37. The control unit 25 issues a command to the motor driver 35, and thus drives various motors 36 that drive the conveyance roller 13, the discharge roller 14, and the carriage 11. Further, the control unit 25 issues a command to the head drive circuit 37 to cause the recording head 20 to discharge the ink. The control unit 25 thus controls the printing operation and the preliminary discharge operation by combining driving of the various motors 36 and the ink discharge from the recording head 20.

It is necessary to perform the preliminary discharge operation at the position that is a predetermined distance away from the edge of the recording medium and the ribs. This is to prevent the preliminary-discharged ink from adhering to the recording medium 10 and the ribs 7. However, if the preliminary discharge position is separated more than necessary from the edge of the recording medium, the throughput is lowered. This can be addressed by predetermining the preliminary discharge position for each size of the recording medium, and performing the preliminary discharge operation at the predetermined position. In such a case, the recording apparatus can obtain the width of the recording medium from the information received from the host apparatus 32 and set the width of the recording medium.

FIG. 4 illustrates the relationship between the width of the recording medium and the preliminary discharge position corresponding thereto. FIGS. 5A and 5B are schematic diagrams illustrating the carriage 11 and the absorbing member 16 on the platen 15 as viewed from a direction in which the recording medium 10 is discharged. Referring to FIGS. 5A and 5B, the detection sensor 22 is used to perform detecting operation. Further, the plurality of preliminary discharge positions 21 (i.e., 21*a*, 12*b*, 21*c*, 21*d*, 21*e*, and 21*f*) is set on the absorbing member 16.

Referring to FIG. 4, if the width of the recording medium is less than A, the recording apparatus uses the preliminary discharge positions 21*c* and 21*d* illustrated in FIGS. 5A and 5B. If the width of the recording medium is greater than or equal to A and less than B, the recording apparatus uses the preliminary discharge positions 21*b* and 21*e*. If the width of the recording medium is greater than or equal to B, the recording apparatus uses preliminary discharge positions 21*a* and 21*f*. The preliminary discharge positions 21*a* and 21*f* are positioned to correspond to the maximum sheet width.

If the recording apparatus determines the preliminary discharge positions based on only the width information of the recording medium obtained from the host apparatus, and the width information obtained from the host apparatus is different from the actual width of the recording medium, the following may occur. The recording apparatus may perform the preliminary discharge operation on the recording medium, or at a position which is farther away than necessary. To address this, the recording apparatus determines the preliminary discharge position using a detection result of the detection sensor in addition to the width information of the recording medium obtained from the host apparatus.

More specifically, the detection sensor detects whether there is a recording medium at a recording medium confirmation position and a preliminary discharge confirmation position. The recording medium confirmation position is the position at which the detection sensor determines whether the width of the actual recording medium is less than the width information of the recording medium obtained from the host apparatus. The preliminary discharge confirmation position is the position at which the detection sensor determines whether the width of the actual recording medium is greater than the width information of the recording medium obtained from the host apparatus. In other words, the detection sensor detects whether there is the recording medium 10 at the recording medium confirmation position which is more inward from a position through which a side edge of the recording medium is expected to pass, based on the width information of the recording medium obtained from the host apparatus. Further, the detection sensor detects whether there is a recording medium 10 at the preliminary discharge confirmation position on the outer side of the position through which the side edge of the recording medium is expected to pass. If the detection sensor detects the recording medium 10 at the recording medium confirmation position and not at the preliminary discharge confirmation position, it can be determined that the edge of the recording medium 10 is located between the recording medium confirmation position and the preliminary discharge confirmation position.

Such confirmation operation will be described below with reference to FIGS. 5A and 5B. When the recording apparatus is to determine whether the width of the actual recording medium is less than the width information of the recording medium obtained from the host apparatus, the detection sensor 22 performs detection as illustrated in FIG. 5A. Referring to FIG. 5A, the detection sensor 22 moves the carriage 11 to a position facing a first confirmation position on the inner side, based on the width information of the recording medium obtained from the host apparatus. The first confirmation position is positioned at a little distance away from the edge of the recording medium to the center side based on the width information of the recording medium obtained from the host apparatus. If the actual size of the recording medium matches the width information of the recording medium obtained from the host apparatus, the detection sensor 22 detects that the recording medium is present.

More specifically, if the intensity of the received reflected light detected by the detection sensor 22 is the same as reference intensity previously measured at a position at which the recording medium is present, it can be determined that there is the recording medium at the first confirmation position.

When the recording apparatus is to determine whether the width of the actual recording medium is greater than the width information of the recording medium obtained from the host apparatus, the detection sensor 22 performs detection as illustrated in FIG. 5B. Referring to FIG. 5B, the detection sensor 22 moves the carriage 11 to a position facing a second confirmation position which is on the outer side of the preliminary discharge position determined based on the width information of the recording medium obtained from the host apparatus.

In such a case, if the intensity of the received reflected light detected by the detection sensor 22 is smaller than the reference intensity, it can be determined that there is no recording medium at the second confirmation position. According to the present exemplary embodiment, the confirmation position is set to 3 mm or more outside of the preliminary discharge position based on experiments.

In other words, the recording medium is detected to be present at the first confirmation position and not to be present at the second confirmation position, the preliminary discharge position 21*b* can be determined as the appropriate preliminary discharge position when performing the printing operation. Since the recording medium is conveyed with reference to the center, the preliminary discharge position 21*e* located symmetric to the preliminary discharge position 21*b* is also determined as the preliminary discharge position when performing the printing operation.

On the other hand, if the detection sensor 22 detects the recording medium at the second confirmation position, the recording apparatus moves the carriage 11 and re-performs detection. More specifically, the recording apparatus moves the carriage 11 so that the detection sensor 22 faces a position at which it can be determined that the recording medium will not be stained by the preliminary discharge operation using the preliminary discharge position 21*a* on the outer side of the preliminary discharge position 21*b*. If the detection sensor 22 detects that the recording medium is not present at such a position, the preliminary discharge position 21*a* and the preliminary discharge position 21*f* corresponding thereto are determined as the preliminary discharge positions when performing the printing operation.

If the detection sensor 22 does not detect the recording medium at the first confirmation position, the ribs may become stained by performing recording. In such a case, the recording apparatus cancels the printing operation.

If the recording apparatus continuously performs recording over a long time, the ink discharged when performing borderless recording (i.e., overall recording) on the recording medium or the preliminary discharged ink may remain on the absorbing member 16 without drying.

Figure 6:
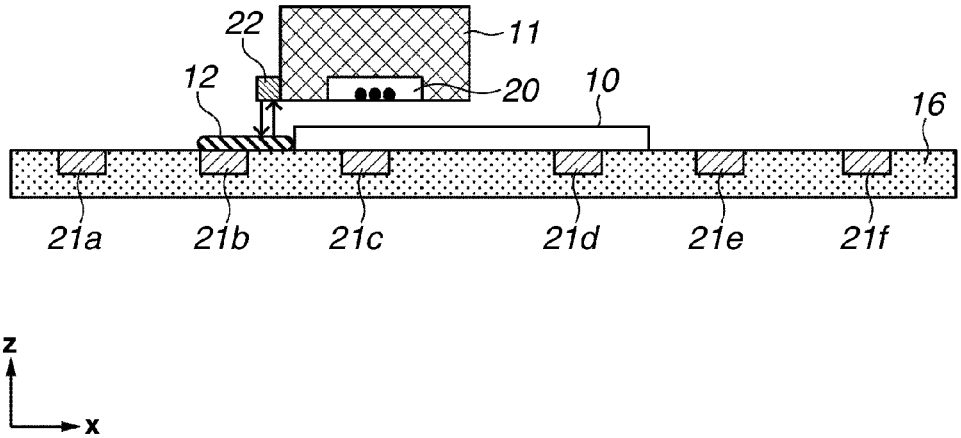
FIG. 6 illustrates a case where the width of the recording medium is falsely detected.

FIG. 6 illustrates the case where the width of the recording medium is falsely detected. Referring to FIG. 6, the intensity of the reflected light from an ink residual substance 12 may be greater than or equal to the reference intensity. If the detection sensor 22 performs detection on the ink residual substance 12, the detection sensor 22 may falsely detect the recording medium even when the recording medium is not actually present. In such a case, the recording apparatus performs the preliminary discharge operation at the preliminary discharge positions 21*a* and 21*f* on the outer side of the appropriate preliminary discharge positions, i.e., the preliminary discharge positions 21*b* and 21*e*. In other words, the carriage 11 moves greatly outwards from the actual edge of the recording medium 10.

If the recording apparatus performs the preliminary discharge operation at the position on the outer side of the appropriate preliminary discharge position, and the recording medium is floating from the platen, the following may occur. When the carriage moves from the outer side of the recording medium to the inner side of the recording medium, the carriage and the edge of the recording medium may interfere. The recording medium may thus be rolled in, or the discharge port surface of the recording head may become damaged.

Figure 7A:
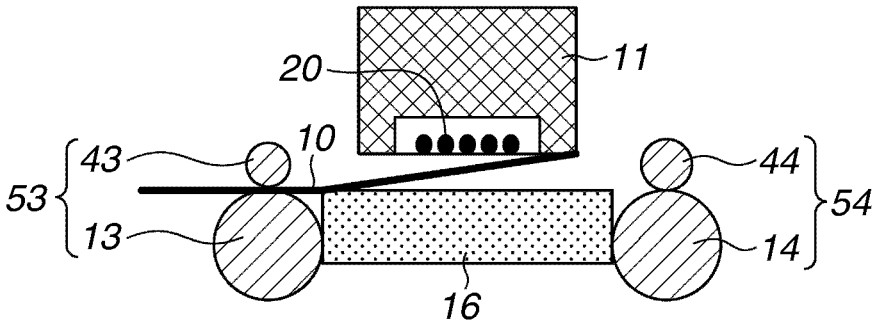
FIGS. 7A, 7B, and 7C illustrate states of the recording medium being conveyed.
Figure 7B:
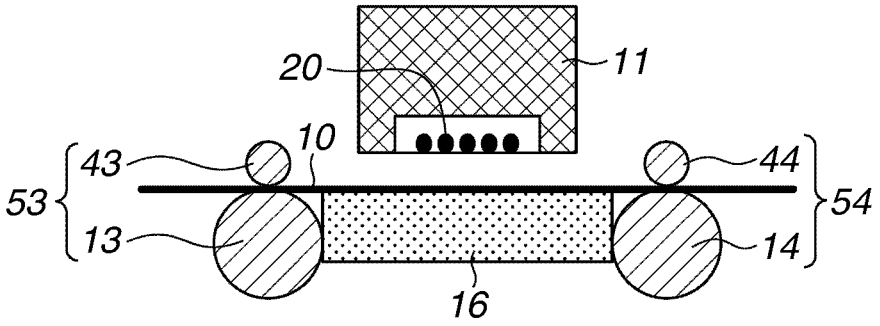
Figure 7C:
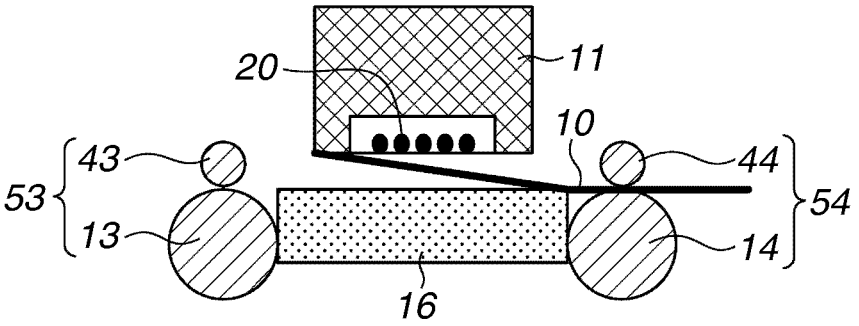

FIGS. 7A, 7B, and 7C illustrate the states in which the recording medium is conveyed. Referring to FIGS. 7A, 7B, and 7C, a conveyance roller pair 53 includes the conveyance roller 13 and a pinch roller 43, and a discharge roller pair 54 includes the discharge roller 14 and a driven roller 44. The state shifts in the order of FIG. 7A, FIG. 7B, and FIG. 7C. The recording medium 10 is conveyed from a left side to a right side in each of the figures.

The conveyance roller pair 53 is located on the upstream side of the recording head 20 in the conveyance direction of the recording medium 10. Further, the discharge roller pair 54 is located on the downstream side of the recording head 20 in the conveyance direction of the recording medium 10. Referring to FIG. 7A, the recording medium 10 fed from the paper feed unit 8 is pinched by only the conveyance roller pair 53 (i.e., a first roller pair), and conveyed to the recording position opposed to the recording head 20. Referring to FIG. 7B, the recording medium 10 is then pinched and conveyed by the conveyance roller pair 53 and the discharge roller pair 54 (i.e., a second roller pair). Referring to FIG. 7C, the recording medium 10 is pinched by only the discharge roller pair 54 and conveyed.

As illustrated in FIGS. 7A and 7C, when the recording apparatus performs recording on the leading edge region and the trailing edge region of the recording medium 10 pinched by only one of the conveyance roller pair 53 and the discharge roller pair 54, the recording medium is unstably held. The floating of the recording medium may thus occur. On the other hand, when the recording apparatus performs printing operation on the center region of the recording medium 10 pinched by both the conveyance roller pair 53 and the discharge roller pair 54, the floating is less likely to occur. This is as illustrated in FIG. 7B.

In other words, when the recording apparatus records on the leading edge region and the trailing edge region of the recording medium, it is necessary to perform the printing operation and the preliminary discharge operations in a state where at least a portion of the carriage 11 overlaps with the recording medium 10. In such a case, the carriage 11 can press on the edge of the recording medium 10, so that the carriage 11 can be prevented from colliding with the edge of the recording medium 10 when moving.

However, if the detection sensor 22 performs false detection as described above, the detection sensor 22 misrecognizes the size of the recording medium 10 to be larger than the actual size. In such a case, the carriage 11 moves greatly outward from the edge of the recording medium 10.

To address this, according to the present exemplary embodiment, when the recording apparatus records on the leading edge region and the trailing edge region of the recording medium, the recording apparatus identifies (i.e., a second identification) the edge position of the recording medium. The recording apparatus identifies the edge position of the recording medium using the width information of the recording medium obtained from the host apparatus 32. The recording apparatus then controls (i.e., a second control) to perform the preliminary discharge operation at the preliminary discharge position corresponding to the identified edge position. By performing the preliminary discharge operation at such a position, the carriage 11 does not collide with the edge of the recording medium 10 even if the detection sensor 22 performs false detection. As a result, the recording medium can be prevented from being rolled in, and the discharge port surface of the recording head can be prevented from becoming damaged.

On the other hand, when the recording apparatus records on the center region of the recording medium 10, it is less likely for the carriage 11 to collide with the edge of the recording medium 10. The recording apparatus thus identifies (i.e., a first identification) the edge position of the recording medium 10 using the detection sensor 22. The recording apparatus then controls (i.e., a first control) to perform the preliminary discharge operation at the preliminary discharge position corresponding to the identified edge position. By performing such control, the recording apparatus can perform with respect to the center region, the preliminary discharge operation at a position near the edge of the recording medium, and shorten the recording time.

The region on the recording medium 10 (i.e., the leading edge region, the center region, and the trailing edge region) at which the recording apparatus performs the printing operation is obtained based on a conveyance amount of the recording medium 10 from when the paper feed sensor 18 has detected the leading edge of the recording medium 10.

If the recording apparatus is to record on the leading edge region and the trailing edge region, and the actual width of the recording medium is greater than the width information of the recording medium obtained from the host apparatus, the preliminary-discharged ink may be impacted on the recording medium. However, since the above-described case is limited to only the leading edge and the trailing edge regions of the recording medium 10, degradation in the quality of the image formed on the recording medium 10 becomes limited.

The printing operation will be described in detail below with reference to the flowcharts.

Figure 8:
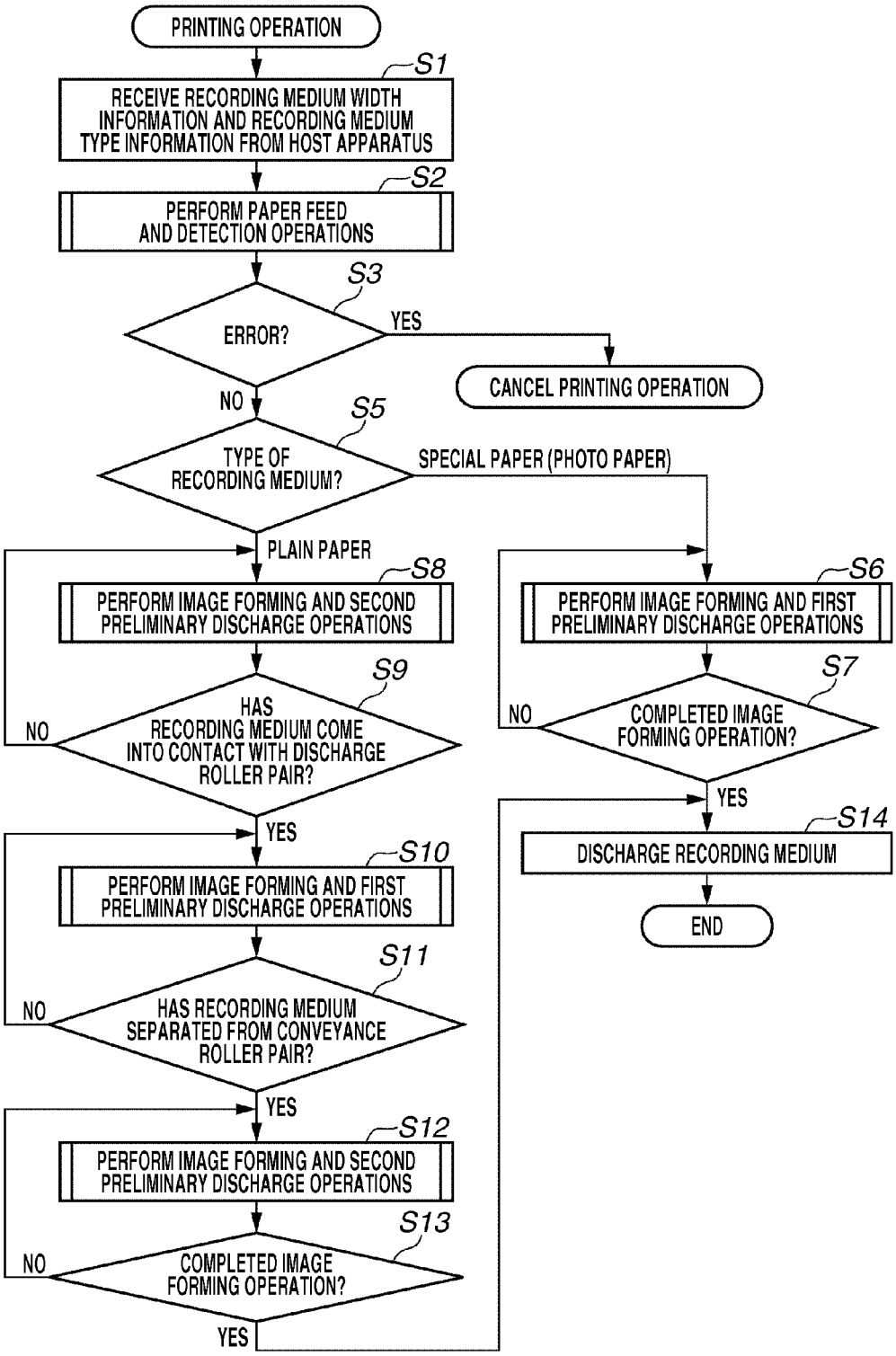
FIG. 8 is a flowchart illustrating a control procedure of a printing operation.

FIG. 8 is a flowchart illustrating the operation in the printing operation. In step S1, the recording apparatus receives from the host apparatus 32, width information and type information (i.e., plain paper or special paper) of the recording medium, and stores the received information in the RAM 27.

The host apparatus 32 generates the width information on the recording medium based on the size information of the recording medium designated when the host apparatus 32 generates the recording data. The control unit 25 receives, when starting the printing operation, the recording medium width information from the host apparatus 32.

In step S2, the recording apparatus performs feeding operation, and performs edge detection operation for the recording medium by the detection sensor 22. The recording apparatus stores in the RAM 27 the preliminary discharge position identified in the detection operation.

In step S3, the recording apparatus determines whether an error has occurred in the edge detection process, i.e., the detected width of the recording medium, detected by edge detection operation is less than the width information of the recording medium received from the host apparatus 32. If the error has occurred (YES in Step 3), the recording apparatus cancels the printing operation. This is because the recording apparatus may discharge the ink on the outer side of the recording medium 10 and stain the ribs on the platen.

On the other hand, if the error has not occurred (NO in step S3), the process proceeds to step S5. In step S5, the recording apparatus determines the type of the recording medium based on the type information of the recording medium received in step S1.

Since the special paper, such as a photo paper, is thick and of high rigidity, it is difficult for the edge of the recording medium to float even when the recording apparatus is recording on the leading edge and the trailing edge of the recording medium. As a result, if the recording apparatus misrecognizes the edge position of the recording medium 10, it is less likely for the carriage 11 to collide with the edge of the recording medium 10. Thus, the recording apparatus performs, when recording on the special paper, the preliminary discharge operation at the position selected based on a result of identifying the edge of the recording medium obtained by the detection sensor 22 regardless of the position in the conveyance direction of the recording medium 10.

If the recording medium is the special paper (SPECIAL PAPER in step S5), in step S6, the recording apparatus performs control to execute the preliminary discharge operation at the preliminary discharge position determined based on the result of identifying the edge of the recording medium obtained by the detection sensor. Hereinafter, the preliminary discharge operation at the preliminary discharge position determined based on the edge identification result obtained by the detection sensor will also be referred to as a "first preliminary discharge operation".

In step S7, the recording apparatus determines whether the image forming operation has been completed. If the image processing operation has not been completed (NO in step S7), the process returns to step S6, and the recording apparatus repeats the image forming operation. If the image forming operation has been completed (YES in step S7), the process proceeds to step S14. In step 14, the recording apparatus discharges the recording medium, and ends the recording operation.

On the other hand, since the plain paper is of low rigidity, there is fear that the recording medium may float in a case where the recording medium 10 is pinched by only one of the conveyance roller pair 53 and the discharge roller pair 54. If it is before the recording medium comes into contact with the discharge roller pair 54, in other words, if the recording medium 10 is pinched by only the conveyance roller pair 53, in step S8, the recording apparatus performs the image forming operation while performing the preliminary discharge operation at the preliminary discharge position selected based on the width information of the recording medium received in step S1. Hereinafter, the preliminary discharge operation at the preliminary discharge position corresponding to the width identified based on the width information of the recording medium may also be referred to as a "second preliminary discharge operation". In step S9, the recording apparatus determines whether the recording medium 10 has come into contact with the discharge roller pair 54 based on the conveyance amount of the recording medium from when the paper feed sensor 18 has detected the leading edge of the recording medium 10.

If the recording apparatus determines that the recording medium 10 has come contacted the discharge roller pair 54 (YES in step S9), i.e., the recording medium 10 is pinched by the conveyance roller pair 53 and the discharge roller pair 54, and it is less likely for the recording medium to float. The process then proceeds to step S10, and the recording apparatus thus performs the image forming operation while performing the preliminary discharge operation at the preliminary discharge position selected as the result of detecting the edge of the recording medium.

In step S11, the recording apparatus determines whether the recording medium 10 has separated from the conveyance roller pair 53. If the recording apparatus determines that the recording medium 10 has separated from the conveyance roller pair 53 (YES in step S11), i.e., the recording medium 10 is pinched by only the discharge roller pair 54, and the process proceeds to step S12. In step S12, the recording apparatus performs the image forming operation while performing the preliminary discharge operation at the preliminary discharge position selected based on the width information of the recording medium received in step S1.

The recording apparatus determines whether the recording medium 10 has separated from the conveyance roller pair 53 based on the conveyance amount of the recording medium 10 from when the paper feed sensor 18 has detected the trailing edge (or the leading edge) of the recording medium 10.

In step S13, the recording apparatus determines whether the image forming operation has been completed. If the image forming operation has not been completed (NO in step S13), the process returns to step S12, and the recording apparatus repeats the image forming operation. If the image forming operation has been completed (YES in step S13), the process proceeds to step S14. In step S14, the recording apparatus discharges the recording medium 10, and the process ends.

Figure 9:
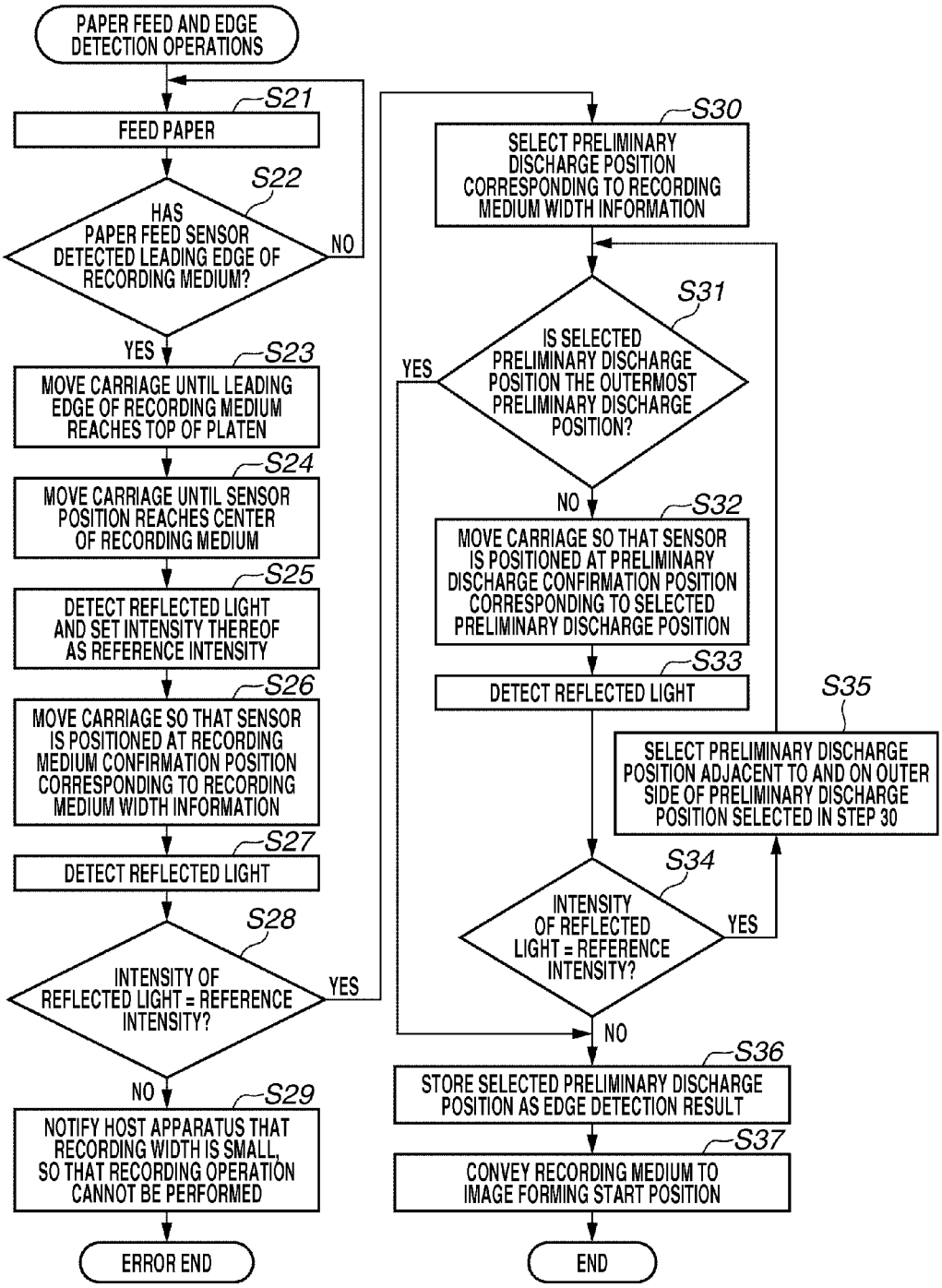
FIG. 9 is a flowchart illustrating a detail procedure of a portion of the steps in the flowchart illustrated in FIG. 8.

The paper feed operation and the recording medium edge detection operation performed in step S2 illustrated in FIG. 8 will be described in detail below with reference to the flowchart illustrated in FIG. 9.

In step S21, the recording apparatus feeds the recording medium 10 until the leading edge of the recording medium 10 is detected by the paper feed sensor 18 (step S22).

In step S22, the recording apparatus determines whether the paper feed sensor 18 has detected the leading edge of the recording medium 10. If the paper feed sensor 18 has detected the leading edge of the recording medium 10 (YES in step S22), the process proceeds to step S23. In step S23, the recording apparatus conveys the recording medium 10 until the leading edge of the recording medium 10 reaches the top of the platen 15 so that the detection sensor 22 can perform the edge detection operation.

In step S24, the recording apparatus moves the carriage 11 so that the detection sensor 22 is positioned at the center of the recording medium 10. In step S25, the recording apparatus causes the light emitting unit in the detection sensor 22 to emit light. The light receiving unit in the detection sensor 22 then detects the reflected light from the recording medium 10, and stores in the RAM 27 the intensity thereof as the reference intensity.

The recording apparatus may convey the recording medium 10 so that the center position of the recording medium 10 becomes the reference line of the recording apparatus as illustrated in FIG. 1. As a result, if the recording apparatus performs detection at the position of the reference line thereof, the recording medium is always detected regardless of the type of the recording medium.

In step S26, the recording apparatus moves the carriage 11 so that the detection sensor 22 is at the first confirmation position. More specifically, if the width of the recording medium matches the width information of the recording medium obtained from the host apparatus, the recording medium can be surely detected at the first confirmation position. In step S27, the recording apparatus causes the light emitting unit in the detection sensor 22 to emit light at the first confirmation position, and detects using the light receiving unit in the detection sensor 22 the reflected light.

In step S28, the recording apparatus compares the intensity of the reflected light detected in step S27 with the reference intensity. If the recording apparatus determines that the intensity of the reflected light is less than the reference intensity (NO in step S28), the process proceeds to step s29. In step S29, the recording apparatus determines that there is no recording medium at the first confirmation position. The recording apparatus then notifies the host apparatus 32 that the width of the recording medium is small, so that the recording operation is not performed, i.e., generates an error message. The process then ends. The recording operation is not performed because, the ink may be discharged on the outer side of the recording medium and stain the ribs.

On the other hand, if the recording apparatus determines that the intensity of the reflected light is equivalent to the reference intensity (YES in step S28), it indicates that there is the recording medium 10 at the first confirmation position. The process then proceeds to step S30. In step S30, the recording apparatus selects as a temporary preliminary discharge position, the preliminary discharge position corresponding to the width information of the recording medium.

In step S31, the recording apparatus determines whether the selected preliminary discharge position is the preliminary discharge position 21*a* corresponding to the recording medium 10 of a maximum recording width. The preliminary discharge position 21*a* is located outermost from the reference line from among the plurality of preliminary discharge positions in the recording apparatus. If the recording apparatus determines that the selected preliminary discharge position is the preliminary discharge position 21*a* (YES in step S31), the process proceeds to step S36. If the preliminary discharge position is the preliminary discharge position 21*a*, the recording apparatus does not stain the recording medium 10 by performing the preliminary discharge operation, regardless of the size of the recording medium 10. In step S36, the recording apparatus thus stores in the RAM 27 the preliminary discharge position selected in step S30 as the position at which preliminary discharge operation is performed in the first preliminary discharge position operation.

If the recording apparatus determines that the selected preliminary discharge position is not the outermost preliminary discharge position (NO in step S31), the process proceeds to step S32. In step S32, the recording apparatus moves the carriage 11 so that the detection sensor 22 is at the second confirmation position corresponding to the selected preliminary discharge position. In step S33, the recording apparatus then causes the light emitting unit in the detection sensor 22 to emit light at the second confirmation position, and the light receiving unit in the detection sensor 22 to detect the reflected light.

In step S34, the recording apparatus compares the intensity of the reflected light detected in step S33 with the reference intensity. If the recording apparatus determines that the intensity of the reflected light is equivalent to the reference intensity (YES in step S34), it indicates that there is the recording medium 10 at the second confirmation position. In other words, the recording apparatus may stain the recording medium at the currently selected preliminary discharge position. In step S35, the recording apparatus selects, as a temporary preliminary discharge position, the preliminary discharge position adjacent to and on the outer side of the preliminary discharge position selected in step S30. The process then returns to step S31.

On the other hand, if the recording apparatus determines that the intensity of the reflected light is less than the reference intensity (NO in step S34), it indicates that there is no recording medium at the second confirmation position. In other words, the recording apparatus can identify that the edge position of the recording medium is to be between the first confirmation position and the second confirmation position. The position selected as the temporary preliminary discharge position is thus most appropriate as the preliminary discharge position corresponding to the identified edge position of the recording medium. The process then proceeds to step S36. In step S36, the recording apparatus stores in the RAM 27 the temporarily selected preliminary discharge position as the position at which the first preliminary discharge operation is to be performed.

In step S37, the recording apparatus conveys the recording medium 10 to the image forming start position. The process then ends.

Figure 10:
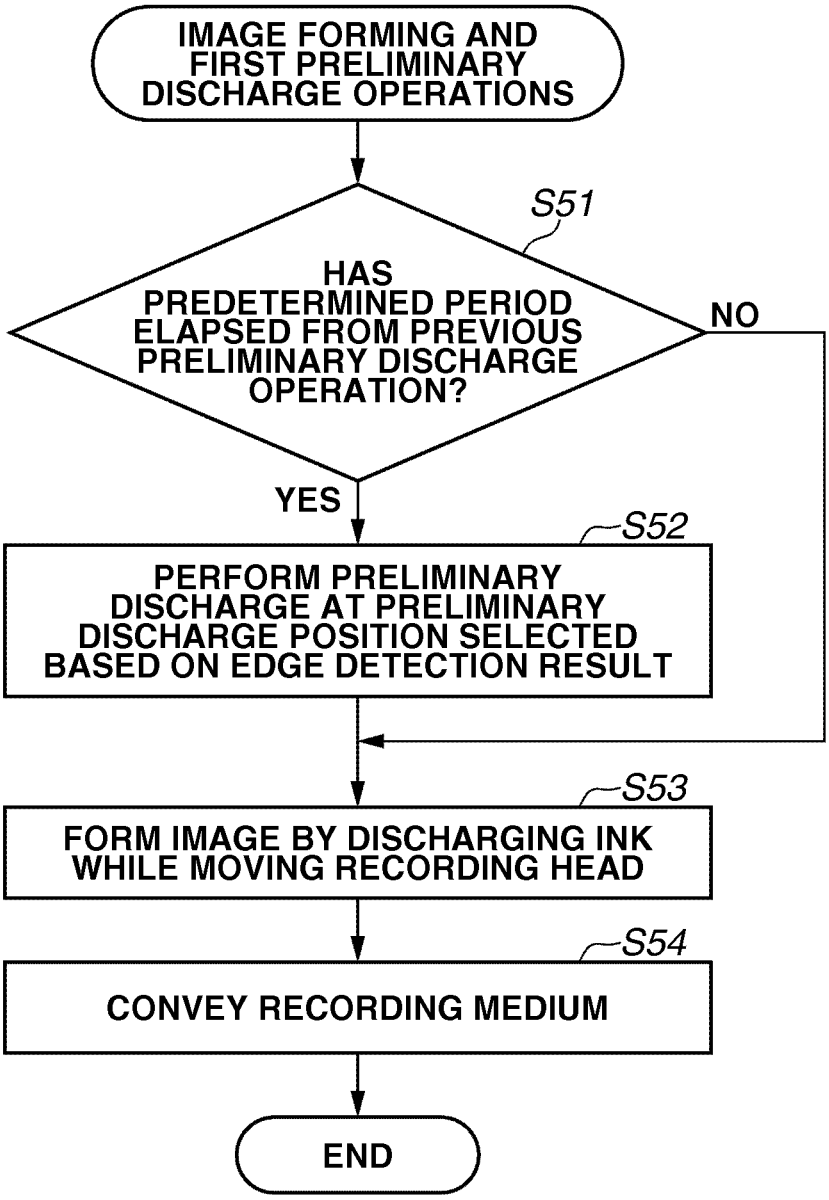
FIG. 10 is a flowchart illustrating a detail procedure of a portion of the steps in the flowchart illustrated in FIG. 8.

FIG. 10 is a flowchart illustrating detailed sequence for the image forming operation and the first preliminary discharge operation performed in Step 6 and Step 10 illustrated in FIG. 8. In step S51, the recording apparatus determines the time that has elapsed from the previous preliminary discharge operation. If the recording apparatus determines that a predetermined time has elapsed from the previous preliminary discharge operation (YES in step S51), the process proceeds to step S52. In step S52, the recording apparatus performs the preliminary discharge operation at the preliminary discharge position selected by the sequence illustrated in FIG. 9. If the recording apparatus determines that a predetermined time has not elapsed from the previous preliminary discharge operation (NO in step S51), it indicates that it is not necessary to perform the preliminary discharge operation. The process then proceeds to step S53. In step S53, the recording apparatus causes the recording head 20 to discharge ink to the recording medium 10 while moving the carriage 11, and thus forms one band of image on the recording medium 10. In step S54, the conveyance roller conveys the recording medium 10, and the process ends.

Figure 11:
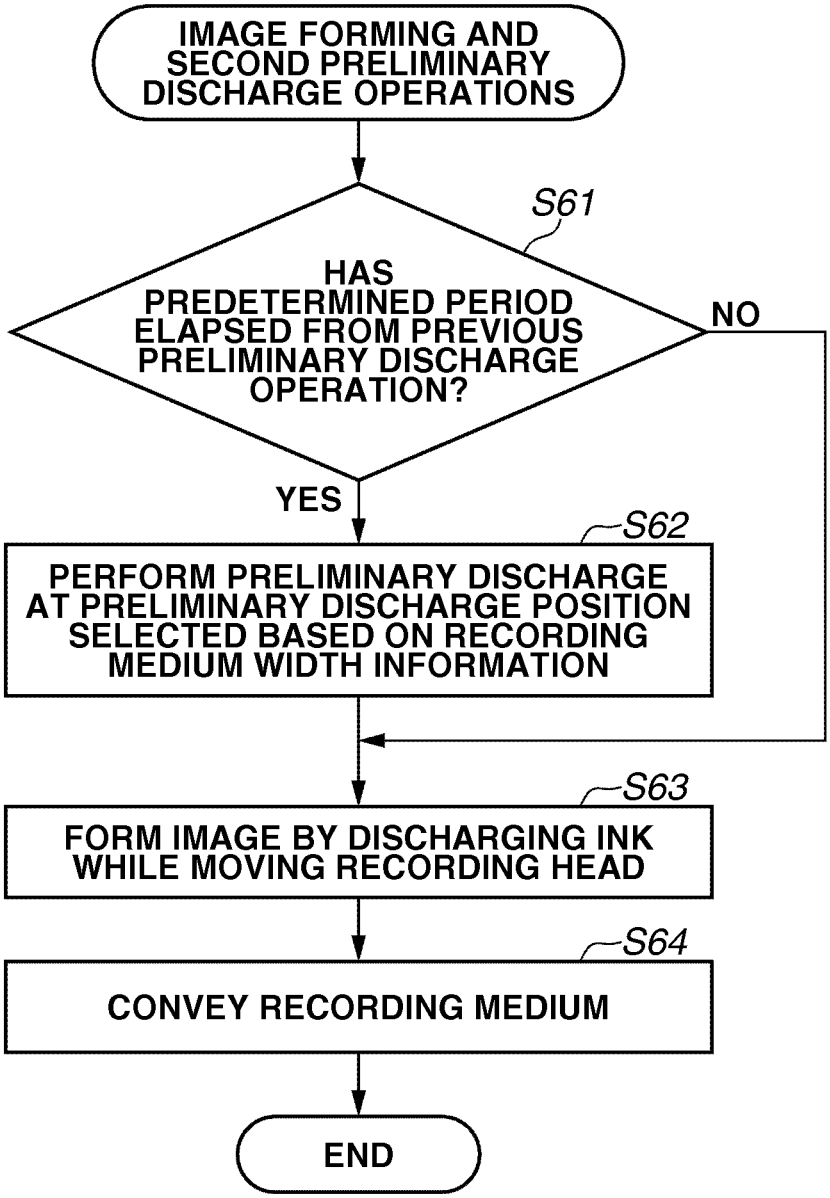
FIG. 11 is a flowchart illustrating a detail procedure of a portion of the steps in the flowchart illustrated in FIG. 8.

FIG. 11 is a flowchart illustrating detailed sequence for the image forming operation and the second preliminary discharge operation performed in Step 8 and Step 12 illustrated in FIG. 8. In step S61, the recording apparatus determines the time that has elapsed from the previous preliminary discharge operation, similarly as in step S51 illustrated in FIG. 10. If the recording apparatus determines that a predetermined time has elapsed from the previous preliminary discharge operation (YES in step S61), the process proceeds to step S62. In step S62, the recording apparatus performs the preliminary discharge operation at the preliminary discharge position corresponding to the width information of the recording medium obtained from the host apparatus. If the recording apparatus determines that a predetermined time has not elapsed from the previous preliminary discharge operation (NO in step S61), it indicates that it is not necessary to perform the preliminary discharge operation. The process then proceeds to step S63. In step S63, the recording apparatus causes the recording head 20 to discharge ink to the recording medium 10 while moving the carriage 11, and thus forms one band of image on the recording medium 10. In step S64, the conveyance roller conveys the recording medium 10, and the process ends.

In other words, if the recording apparatus is to record on the leading edge and the trailing edge of the recording medium, the recording apparatus performs the preliminary discharge operation (i.e., the second preliminary discharge operation) at the preliminary discharge position corresponding to the width information of the recording medium received from the host apparatus 32. If the recording apparatus is to record on the center region of the recording medium, the recording apparatus performs the preliminary discharge operation (i.e., the first preliminary discharge operation) at the preliminary discharge position corresponding to the width of the recording medium detected using the detection sensor. The recording apparatus can thus perform control to execute the above-described preliminary discharge operations.

By performing such control, the recording apparatus can prevent, when the carriage returns from the preliminary discharge position to above the recording medium, the recording medium and the carriage from interfering with each other. At the same time, the recording apparatus can perform the preliminary discharge operation at the position near the edge of the recording medium. As a result, the recording medium can be prevented from being rolled in (i.e., jamming) when the recording medium is conveyed, the recording head can be prevented from becoming damaged, and the recording time can be shortened.

The above-described process is an example, and the number of preliminary discharge positions is not limited thereto. Further, the preliminary discharge position may also be located on one side of the recording medium. Furthermore, the preliminary discharge position is not limited to be located above the platen (absorbing member). The preliminary discharge operation may also be performed towards the capping mechanism which is positioned at a distance from the recording medium. In such a case, if the recording medium 10 is pinched by both the conveyance roller pair 53 and the discharge roller pair 54, the recording apparatus performs control to execute the preliminary discharge operation at the preliminary discharge position selected as a result of detecting the edge of the recording medium, and on the capping mechanism. On the other hand, if the recording medium 10 is pinched by either the conveyance roller pair 53 or the discharge roller pair 54, the recording apparatus performs control to execute the preliminary discharge operation at the preliminary discharge position corresponding to the width information of the recording medium. As a result of performing such control, the recording apparatus can prevent the recording medium and the carriage from interfering with each other when the carriage returns from the preliminary discharge position to above the recording medium. This similar to the result obtained in the above-described example.

Further, according to the examples illustrated in FIGS. 10 and 11, the recording apparatus determines whether to perform the preliminary discharge operation based on the time that has elapsed from the previous preliminary discharge operation. However, the recording apparatus may also determine based on a different condition. For example, the recording apparatus may determine based on timing at which a predetermined number of bands of the image has been formed, or the timing at which a moving amount of the carriage 11 has reached a predetermined distance.

Furthermore, according to the above-described example, the recording apparatus is connected to the host apparatus 32 via the I/F 31, and the control unit 25 receives the width information of the recording medium from the host apparatus 32. However, the method for obtaining the width information of the recording medium and the recording data is not limited thereto. For example, the inkjet recording apparatus may be integrated with an image reading apparatus, so that the image read by the image reading apparatus becomes the recording data. Further, the width information of the recording medium may be generated from the reading result. Furthermore, the inkjet recording apparatus may be connectable to a portable storage medium, and thus obtain the recording data from the portable storage medium. Moreover, the control unit may be connected to a user I/F, and thus obtain the width information of the recording medium received by an input through the user I/F.

While the present disclosure has been described with reference to exemplary embodiments, it is to be understood that these embodiments are not limiting. The scope of the following claims is to be accorded the broadest interpretation so as to encompass all such modifications and equivalent structures and functions.

This application claims the benefit of Japanese Patent Application No. 2012-203090 filed Sep. 14, 2012, which is hereby incorporated by reference herein in its entirety.

What is claimed is:

1. An inkjet recording apparatus comprising:

a carriage on which a recording head configured to discharge ink and perform recording on a recording medium is mounted and configured to move in a first direction;

a first roller pair located on an upstream side of the recording head in a conveyance direction that intersects the first direction;

a second roller pair located on a downstream side of the recording head in the conveyance direction;

a detection sensor configured to detect an edge position of a recording medium in the first direction, and a determination unit configured to determine a position of the recording head in the first direction at a time of performing a preliminary discharge operation, wherein the determination unit determines the position of the recording head by a first determination operation in a case where a recording medium is being pinched by both the first roller pair and the second roller pair, and determines the position of the recording head by a second determination operation in a case where the recording medium is being pinched by either one of the first roller pair or the second roller pair.

2. The inkjet recording apparatus according to claim 1, wherein the determination unit, depending on a type of the recording medium, in a case where the recording medium is being pinched by either the first roller pair or the second roller pair, determines the position of the recoding head by the first determination operation.

3. The inkjet recording apparatus according to claim 1, wherein the detection sensor is located on the carriage.

4. The inkjet recording apparatus according to claim 1, wherein the detection sensor optically detects presence or absence of a recording medium.

5. The inkjet recording apparatus according to claim 4, wherein the control unit causes the detection sensor to perform detection operation at a plurality of positions in the first direction.

6. The inkjet recording apparatus according to claim 1, further comprising a control unit configured to, in a case where a width of a recording medium detected by the detection sensor is less than a width of a recording medium obtained by the width information, cancel a recording operation.

7. The inkjet recording apparatus according to claim 1, wherein an area in which the carriage moves when performing the preliminary discharge operation is greater than an area in which the carriage moves when performing the recording operation.

8. The inkjet recording apparatus according to claim 1, further comprising a passing detection sensor configured to detect a leading edge or a trailing edge of a recording medium, wherein the preliminary discharge unit determines a position of a recording medium in a conveyance direction based on a detection result of the passing detection sensor.

9. The inkjet recording apparatus according to claim 1, wherein the preliminary discharge unit performs the preliminary discharge operation at any of a predetermined plurality of preliminary discharge positions.

10. The inkjet recording apparatus according to claim 1, further comprising:

a supporting member configured to support a recording medium at a position facing the recording head; and an absorbing member disposed on the supporting member and configured to absorb ink, wherein the preliminary discharge operation is performed with respect to the absorbing member.

* * * * *